United States Patent [19]

Berglund et al.

[11] 4,118,095

[45] Oct. 3, 1978

[54] WIRE CONNECTING BLOCK

[75] Inventors: Richard Newman Berglund, Bridgewater; John Paul Pasternak, Whippany, both of N.J.

[73] Assignee: Bell Telephone Laboratories, Incorporated, Murray Hill, N.J.

[21] Appl. No.: 813,306

[22] Filed: Jul. 6, 1977

[51] Int. Cl.[2] ..... H01R 13/38

[52] U.S. Cl. ..... 339/99 R

[58] Field of Search ..... 339/97 R, 97 P, 98, 339/99 R

[56] References Cited

U.S. PATENT DOCUMENTS

| | | | |
|---|---|---|---|
| 3,496,522 | 2/1970 | Ellis, Jr. et al. | 339/99 R |
| 3,772,635 | 11/1973 | Frey et al. | 339/99 R |
| 3,778,750 | 12/1973 | Caveney et al. | 339/97 R |
| 3,798,587 | 3/1974 | Ellis, Jr. et al. | 339/97 P |
| 4,053,197 | 10/1977 | Teagno | 339/99 R |

*Primary Examiner*—Joseph H. McGlynn
*Attorney, Agent, or Firm*—John W. Fisher

[57] ABSTRACT

A wire connecting block includes a pair of mating connectors for effecting electrical cross-connections between a first set of conductors and a second set of conductors. The first connector indexes the first conductors and holds them in alignment for engagement with a plurality of insulation-penetrating slotted beam contacts carried by the second connector. An integral skirt, along the bottom edge of the second connector, covers exposed ends of the first conductors to maintain electrical isolation therebetween. Opposite ends of the slotted beam contacts, exposed along a top edge of the second connector engage the second set of conductors for cross-connection to the first set of conductors.

20 Claims, 9 Drawing Figures

WIRE CONNECTING BLOCK

BACKGROUND OF THE INVENTION

1. Field of the Invention

This invention relates to improved devices for making electrical cross-connections between two sets of conductors and, in particular, to improved devices which increase the amount of electrical isolation between adjacent conductors in the cross-connected sets of conductors.

2. Description of the Prior Art

Wire connecting blocks of the type disclosed in B. C. Ellis, Jr. U.S. Pat. No. 3,611,264, issued Oct. 5, 1971, include an indexing strip and a connecting block, the latter of which carries a plurality of slotted beam contacts. The indexing strip has a plurality of uniform height, spaced-apart teeth along its length. These teeth aid in indexing a first set of conductors. A corresponding plurality of uniform height, spaced-apart teeth carried by the connecting block serve to index a second set of conductors to be cross-connected through the slotted beam contacts to the first set of conductors.

A number of improvements to the basic Ellis, Jr. connecting block are disclosed in B. C. Ellis, Jr. et al U.S. Pat. No. 3,798,587, issued Mar. 19, 1974. In the improved version the spaced-apart teeth in both the indexing strip and the connecting block are staggered in height to facilitate indexing each set of conductors. The Ellis, Jr. et al connecting block is a two-piece structure the parts of which are secured together following insertion of the slotted beam contacts. While this connecting block arrangement has proved to be satisfactory in some applications, we have found that when the connecting block is placed over the indexing strip in cold temperatures certain stresses are applied to the bond between the two connector parts. These stresses often rupture the bond causing failure of the entire unit.

In other applications, such as outdoor environments, moisture collects across the exposed conductor ends. This moisture oftentimes results in short circuits between some of the conductors. In an attempt to alleviate this problem, an insulative, greaselike compound is placed in the connector cavity. While this greaselike compound aids in the reduction of electrical short circuits, unfortunately it further increases the mechanical stresses applied to the joint between the two connector parts as the connector is brought into engagement with the indexing strip. The present application is directed to further improvements in the connecting block structures disclosed in the aforementioned patents.

It is one object of the present invention to alleviate the mechanical stresses produced during engagement of the connecting block with the indexing strip.

Another object is to encase the exposed ends of the conductors thereby electrically insulating them from one another.

A further object of the present invention is to improve the locking arrangement between the connector body and the indexing strip.

Yet another object is to improve the indexing strip in order to facilitate engagement of the connecting block therewith.

Still a further object is to provide a conductor holding arrangement in the indexing strip to hold indexed conductors in place prior to engagement with the connecting block.

An even further object of the present invention is to increase the electrical isolation among a second set of conductors when brought into engagement with the connecting block and ultimately the first set of conductors.

Still a further object is to configure the connecting block such that it is readily engageable with a test cord.

SUMMARY OF THE INVENTION

The foregoing objects as well as other objects of the invention are realized in an illustrative embodiment of apparatus for electrically interconnecting first conductors with associated second conductors. This interconnection apparatus includes first and second mating connectors which are made of electrically insulative material. The first connector has provision therein for individually receiving and indexing the first conductors. Ends of these first conductors are exposed along one side of the first connector. The second connector carries a plurality of slotted beam contacts which are held in a predetermined spatial relationship so as to be engageable with the first and second sets of conductors, respectively. A skirt portion integral with the second connector encases the exposed ends of the first conductors to electrically isolate them from one another.

Accordingly, it is one feature of the present invention that the second connector is configured so as to alleviate mechanical stresses heretofore applied to a bond joint.

Another feature is that the second connector includes provision for facilitating alignment of the slotted beam contacts therein.

Still another feature of the present invention is that the second connector has integral therewith a skirt which encases exposed conductor ends of the first set of conductors.

A further feature is that an end of the second connector opposite the end having the skirt provides increased electrical isolation among the conductors of the second set of conductors.

Yet another feature is that the first connector includes funnel-shaped entry ways on spaced-apart indexing teeth to facilitate alignment of the first and second connectors during mating.

An even further feature of the present invention is that the first connector includes an anvil to facilitate wire cutoff.

Yet a further feature is that the spaced-apart teeth of the first connector have opposed depressions in adjacent sidewalls to facilitate capture of the first set of conductors as they are indexed.

Still a further feature of the present invention is that the locking arrangement between the first and second connectors is improved through the provision of truncated cylindrical projections along sidewalls of the spaced-apart teeth on the first connector. These truncated cylindrical projections have a thickness at their bottom which is greater than the thickness at the top and this variation in thickness ensures a tight retention with a plurality of apertures in sidewalls of the second connector.

Still a further feature is that the bottom sidewalls of the second connector are scalloped to decrease interference with larger outside diameter wires.

Still another feature of the present invention is that alternate spaced-apart teeth of the second connector have barbed tips thereon to assist in holding a test cord in connection therewith.

BRIEF DESCRIPTION OF THE DRAWINGS

The aforementioned objects and features, as well as other objects and features, will be better understood upon consideration of the following detailed description and the appended claims, taken in conjunction with the attached drawings in an illustrative embodiment in which:

DETAILED DESCRIPTION

Figure 1:
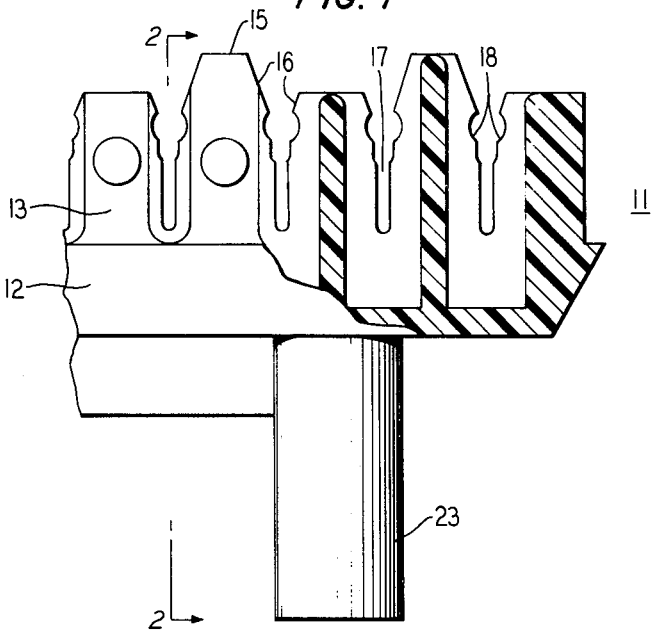
FIG. 1 is a side view of a first connector illustrating the improved wire capture arrangement.

A first mating connector, hereinafter denoted as indexing strip 11 and shown in FIGS. 1 through 3, includes a longitudinally extending body member 12. Integral with body member 12 and extending generally perpendicular to an axis thereof are a plurality of spaced-apart teeth 13. Teeth 13 alternate in height to facilitate indexing of a first set of conductors 14 shown in FIG. 9. To further facilitate wire indexing, teeth 13, as shown in FIG. 1, have tapered tip regions 15 on adjacent sidewalls 16. These tapered tip regions 15 form generally funnel-shaped wire entry ways for directing conductors 14 into wire retaining slots 17 formed by spaced-apart teeth 13.

Adjacent sidewalls 16 of spaced-apart teeth 13 have integral therewith a pair of opposed depressions 18 for capturing and holding an indexed conductor 14 in a wire retaining slot 17. Opposed depressions 18 are located at an intermediate point along the height of teeth 13 above wire retaining slot 17.

Figure 2:
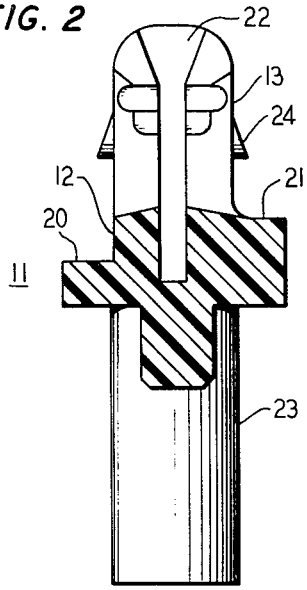
FIG. 2 is an end view of the first connector illustrating the truncated cylindrical projections for improved connector locking, the funnel-shaped entry way for facilitating alignment of the second connector with the first connector, and the wire cutoff anvil.
Figure 3:
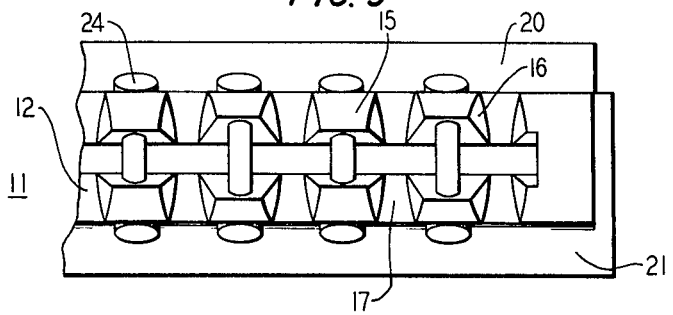
FIG. 3 is a top view of the first connector illustrating tapered slots used in effecting wire indexing.
Figure 9:
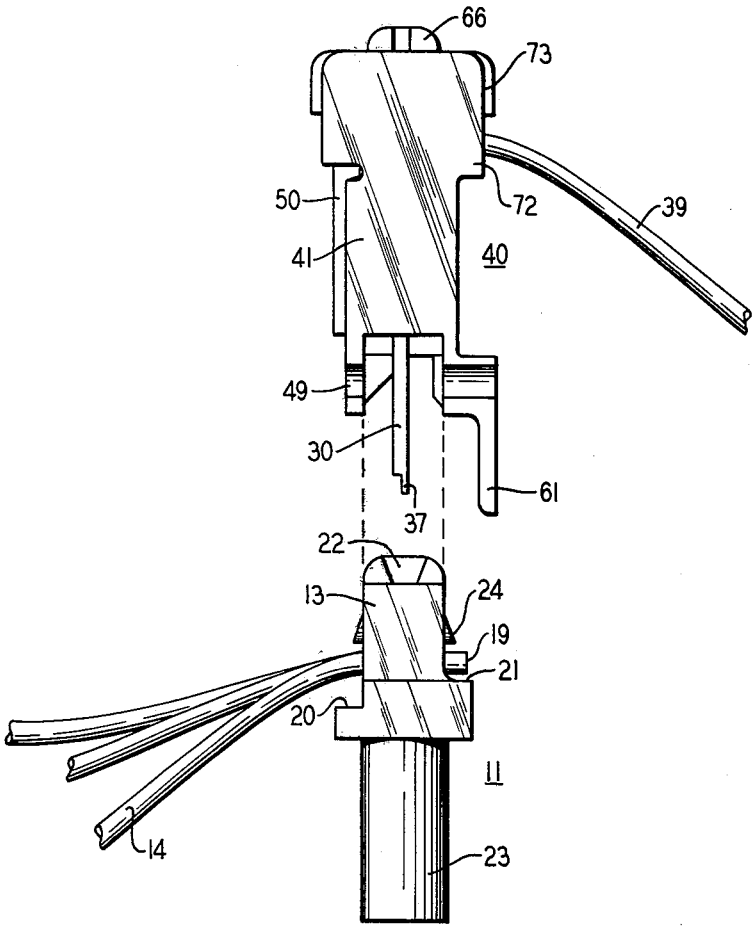
FIG. 9 is a composite end view of the first and second connectors aligned for mating connection with one another and further illustrating encasement of the exposed wire ends of the first set of conductors.

Extending along a length of body member 12 are outwardly projecting edges 20 and 21, as shown in FIG. 2. Edges 20 and 21 are at different elevations along body member 12 with edge 20 being at a lower elevation than edge 21 when viewed from tapered tip regions 15 of spaced-apart teeth 13. This difference in elevation of edges 20 and 21 enables a polarized engagement of indexing strip 11 with a second mating connector 40, as shown in FIG. 9. Edge 21 has a width nearly twice the width of edge 20. This difference in width facilitates cutoff of first conductors 14 by a tool (not shown).

Also shown in FIG. 2 is a generally funnel-shaped channel 22 which is integral with sidewall 16 of spaced-apart teeth 13. A similar channel 22 is integral with an opposed sidewall 16 of teeth 13. These funnel-shaped channels 22 have widths of greater extent at tip regions 15 of teeth 13 to facilitate directing slotted beam contacts 30, carried by second mating connector 40 and shown in FIG. 4, into engagement with indexed conductors 14, as shown in FIG. 9.

Indexing strip 11 is affixed to a support carrier (not shown), similar to that illustrated as element 36 in FIG. 2 of U.S. Pat. No. 3,798,587, issued to B. C. Ellis, Jr. et al on Mar. 19, 1974, by cylindrical posts 23. Posts 23 are inserted into apertures in the support carrier and heated to produce an expanded head similar to that of a rivet.

In order to securely couple indexing strip 11 to second mating connector 40, a plurality of truncated cylindrical projections 24 are integrally provided on outer walls of spaced-apart teeth 13. Projections 24, as shown in FIGS. 2 and 3, have a greater thickness near an edge opposite tip regions 15 of spaced-apart teeth 13. This coupling arrangement will be considered in further detail following the description of second mating connector 40.

Figure 4:
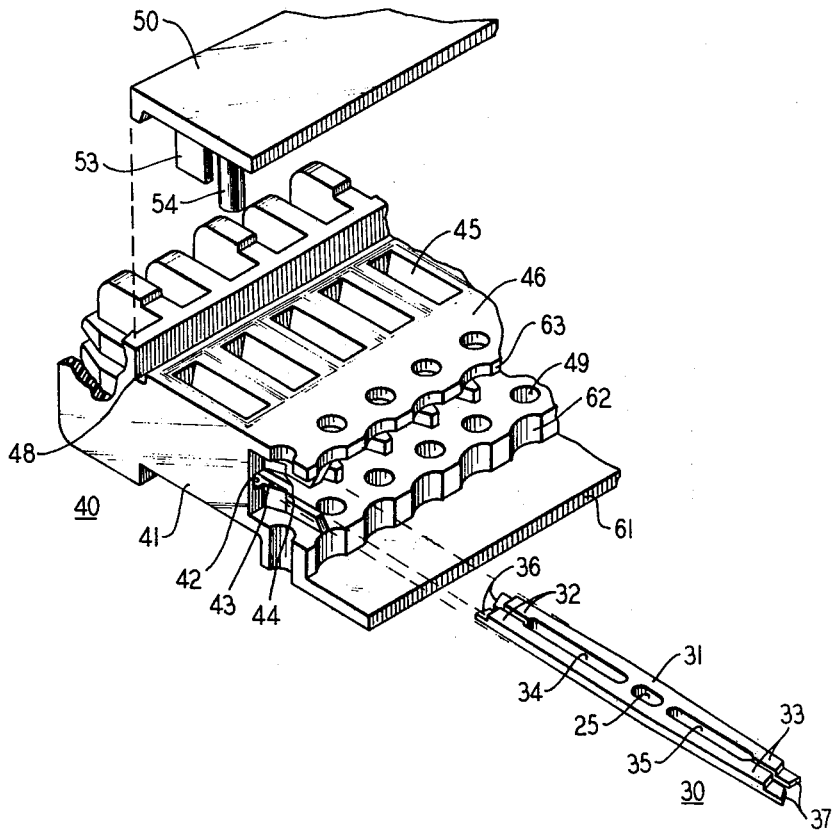
FIG. 4 is an exploded partial perspective view of the second connector illustrating the improved arrangement for mounting the slotted beam contacts therein.

Once conductors 14 are indexed, cross-connections among these conductors and conductors 39 of a second set, as shown in FIG. 9, are effected through a plurality of slotted beam contacts 30, shown in FIG. 4. Each of contacts 30 includes a central portion 31 which has first and second pairs of oppositely directed cantilever beams 32 and 33 extending therefrom. Each of the beams in the pairs of beams 32 and 33 are spaced apart from one another by elongated generally rectangular apertures 34 and 35, respectively. Apertures 34 and 35 extend from central portion 31 to a point near a pair of oppositely directed insulation-penetrating edges 36 and 37, respectively, at the ends of beams 32 and 33. It should be noted that beams 33 are of shorter length than beams 32 to increase the force provided by edges 37 during engagement with conductor insulation. Also included in central portion 31 is a generally oval-shaped aperture 25 used in mounting contact 30 in mating connector 40.

The second mating connector 40, shown in FIG. 4, is comprised of a body member 41 which has a plurality of elongated generally rectangular cavities 42 therein for slidably engaging slotted beam contacts 30. Extending partially along planar inner sidewalls 43 of cavities 42 are channel cavities 44. A corresponding plurality of spaced-apart apertures 45 are included in an outer sidewall 46 of body member 41. Spaced-apart apertures 45 are aligned in one-to-one correspondence with rectangular cavities 42 and channel cavities 44.

Figure 5:
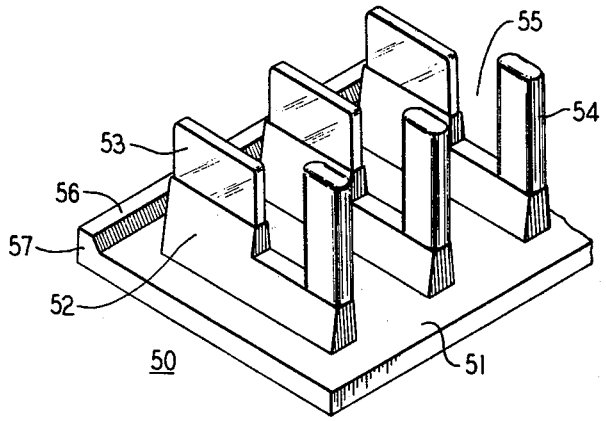
FIG. 5 is a partial perspective view of a comblike slotted beam contact retainer, the comblike members of which absorb shear stresses produced during engagement of the second connector with the first connector.
Figure 6:
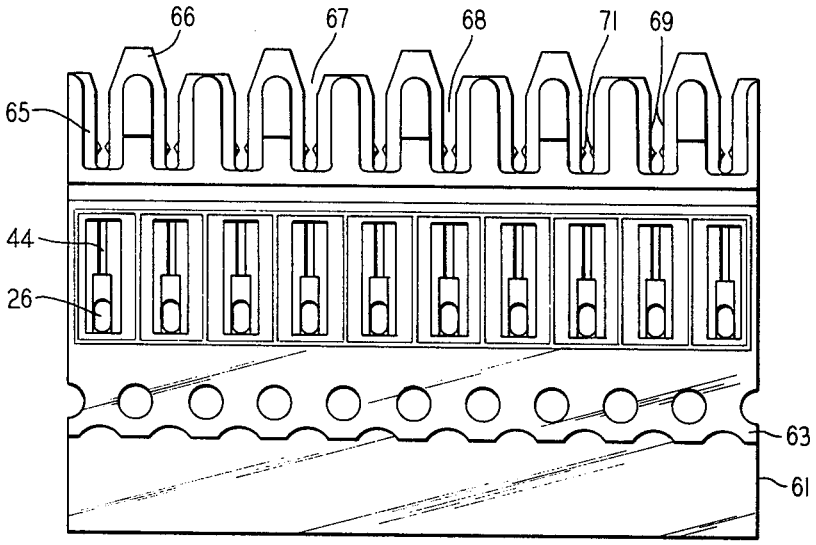
FIG. 6 is a side view of the second connector illustrating the scalloped edges for decreasing interference with larger outside diameter wires.

Once slotted beam contacts 30 are inserted into rectangular cavities 42 and aligned such that aperture 25 is beneath a corresponding aperture 26, shown in FIG. 6, anchoring member 50 is brought into engagement with body member 41. Anchoring member 50, shown in FIG. 5 is comprised of a generally flat rectangular member 51. Integral with member 51 and extending outwardly therefrom are a plurality of spaced-apart generally triangular projections 52. Extending from tops of triangular projections 52 are projections 53 and 54. Interposed between projections 53 and 54 is a notch 55 the width of which is approximately equal to a width of central portion 31 between apertures 25 and 34 of contact 30.

Triangular projections 52, in conjunction with projections 53 and 54 and the depth of notch 55, limit the extent of engagement of slotted beam contact 30 with rectangular member 51. It should be noted that projection 53 extends into channel cavities 44. This mounting arrangement for slotted beam contacts 30 couples insertion forces produced during engagement of second mating connector 40 with indexing strip 11 into projections 53 and 54. Consequently, the insertion forces tend toward the shearing of projections 53 and 54 rather than the splitting of body member 41.

To ensure proper alignment of anchoring member 50 with body member 41, the former includes a projecting lip 56 along a lengthwise edge 57. Outer sidewall 46 has a mating groove 48 extending along its length. This lip and groove arrangement provides a polarized mating of anchoring member 50 with body member 41. Once in place these two members are secured to one another, for example, by ultrasonic welding.

Figure 7:
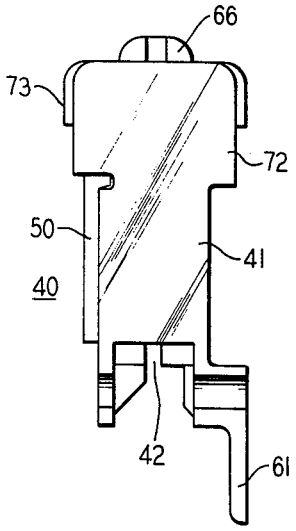
FIG. 7 is an end view of the second connector illustrating the extended skirt used to improve the electrical isolation among the first set of conductors and the barbed ends used to assist the holding of a test cord in place on the second connector.

As shown most clearly in FIGS. 7 and 9, body member 41 has integral therewith and extending outwardly away therefrom a generally L-shaped skirt 61. A plurality of scallops 62, as shown in FIG. 4, along the base leg of the "L" and along opposite edge 63, engage conductors 14, as shown in FIG. 9, and hold them in place between indexing strip 11 and mating connector 40. Skirt 61 encases exposed ends 19 of first conductors 41 to electrically isolate them from one another. Not only does the insulative material of which both indexing strip 11 and mating connector 40 are made provide electrical isolation, but skirt 61 in conjunction with sealing compound (not shown) shields exposed ends 19 to prevent any accumulation of moisture which could cause electrical short circuits.

After first conductors 14 are individually received and indexed in indexing strip 11 and conductor ends 19 are trimmed to the proper length, mating connector 40 with the plurality of slotted beam contacts 30 therein is brought into engagement with indexing strip 11. Mating connector 40 is coupled securely to indexing strip 11 by projections 24 which engage a corresponding plurality of circular apertures 49 in sidewall 46 and skirt 61. Circular apertures 49 are aligned in correspondence with truncated cylindrical projections 24 so that apertures 49 surround projections 24 with the greater thickness inhibiting separation of mating connector 40 from indexing strip 11 once the two are mated.

It should be noted that mating connector 40 holds the slotted beam contacts 30 in a spatial relationship so that an individual contact 30 is engageable with an individual conductor 14. Opposite ends of contacts 30 are now available for engagement with second conductors 39, as shown in FIG. 9.

Figure 8:
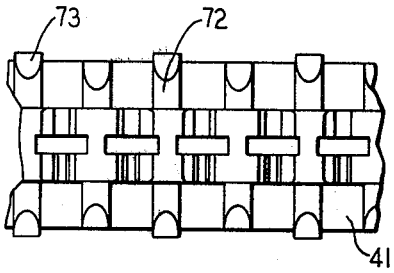
FIG. 8 is a top view of the second connector illustrating the mechanism for improving the electrical isolation among the second set of conductors.

To facilitate alignment and indexing of second conductors 39, mating connector 40, as shown in FIGS. 6 through 8, has a plurality of spaced-apart, alternating height teeth 65 integral with body member 41. Teeth 65 have a configuration somewhat similar to that of teeth 13 on indexing strip 11 insofar as teeth 65 have tapered tip regions 66 forming funnel-shaped wire entry ways 67. Near the bottom of wire retaining slots 68 formed by adjacent sidewalls 69 of teeth 65 there are oppositely directed interference projections 71. Projections 71 have a thickness of greater extent at a central point therein which is removed from taper tip regions 66. Projections 71 facilitate capture and inhibit conductors 39 from separating from mating connector 40 after being seated in contacts 30.

Electrical isolation is provided among exposed ends of conductors 39 by extended lateral projections 72 on teeth 65 as shown in FIG. 8. These extended projections 72 increase the electrical path length between adjacent exposed conductor ends. On outer edges of alternate ones of projections 72 are projecting lips 73 for facilitating engagement of a test cord (not shown) with mating connector 40.

In all cases, it is to be understood that the above-described embodiment is illustrative of but a small number of many possible specific embodiments which can represent applications of the principles of the invention. Thus, numerous and various other embodiments can be devised readily in accordance with these principles by those skilled in the art without departing from the spirit and scope of the invention.

We claim:

1. Apparatus for electrically interconnecting first conductors with associated second conductors comprising:

first and second mating connectors made of an electrically insulative material, said first connector having provision therein for individually receiving and indexing said first conductors, ends of which are exposed along one side of said first connector;

a plurality of slotted beam contacts;

means, integral with said second connector, for holding said slotted beam contacts in a predetermined spatial relationship wherein said slotted beam contacts are engageable with said first and second conductors, respectively; and means, integral with said second connector, for encasing said exposed ends of said first conductors to electrically isolate them from one another, said encasing means comprising a generally L-shaped skirt integral with and projecting away from said second connector, said integral skirt being scalloped along the base of said generally L-shape, the scallops engaging said first conductors and holding them in place between said first and second connectors.

2. The apparatus in accordance with claim 1 wherein said first connector includes:

a longitudinally extending body member;

first and second projecting side edges extending along a length of said body member, said first and second side edges being at different elevations along said body member such that said first side edge is at a higher elevation than said second side edge to enable polarized engagement of said first and second connectors, said first side edge having a width nearly twice the width of said second side edge to facilitate cutoff of said first conductors.

3. The apparatus in accordance with claim 1 wherein said first connector includes:

a longitudinally extending body member;

a plurality of spaced-apart teeth integral with said body member and extending generally perpendicular to an axis of said body member, said teeth alternating in height to facilitate indexing of said first conductors;

means, integral with adjacent sidewalls of each of said spaced-apart teeth, for directing said first conductors into wire retaining slots formed by said spaced-apart teeth; and means, integral with adjacent sidewalls of each of said spaced-apart teeth, for capturing and holding said indexed first conductors in said wire retaining slots.

4. The apparatus in accordance with claim 3 wherein said directing means comprises tapered tip regions on adjacent sidewalls of said spaced-apart teeth, said tapered tip regions forming generally funnel-shaped entry ways for said first conductors.

5. The apparatus in accordance with claim 3 wherein said capturing and holding means comprises first and second opposed depressions in adjacent sidewalls of said spaced-apart teeth, said opposed depressions located at an intermediate point along the height of said teeth above said wire retaining slots.

6. The apparatus in accordance with claim 3 wherein said first connector further includes:

means, integral with opposed sidewalls of each of said spaced-apart teeth, for directing said plurality of slotted beam contacts held by said second connector into engagement with said indexed first conductors.

7. The apparatus in accordance with claim 6 wherein said directing means comprises generally funnel-shaped channels on adjacent sidewalls of said spaced-apart teeth, said channels having a width of greater extent at tips of said teeth, said channels funneling said slotted beam contacts carried by said second connector into engagement with said indexed first conductors.

8. The apparatus in accordance with claim 1 wherein each of said plurality of slotted beam contacts includes:

a central portion having a generally oval-shaped aperture therein;

first and second pairs of oppositely directed cantilever beams, each of said beams in said pairs of beams spaced apart from one another by an elongated generally rectangular aperture extending from said central portion a predetermined distance along said beams, said first pair of beams being shorter in length than said second pair of beams; and first and second oppositely directed insulation-penetrating edges at ends of each of said beams in said pairs of beams.

9. The apparatus in accordance with claim 8 wherein said slotted beam contact holding means comprises:

a body member having a plurality of elongated generally rectangular cavities therein for slidably engaging said plurality of slotted beam contacts;

channel cavity means extending partially along planar inner sidewalls of said cavities;

an outer sidewall extending along a length of said body member, said outer sidewall having a plurality of spaced-apart apertures therein aligned in one-to-one correspondence with said plurality of rectangular cavities and said channel cavity means; and means, engageable with said aligned plurality of apertures in said outer sidewall, one of said elongated generally rectangular apertures in said plurality of slotted beam contacts and said generally oval-shaped aperture in said contacts, and said channel cavity means, for anchoring said slotted beam contacts in said second connector.

10. The apparatus in accordance with claim 9 wherein said anchoring means comprises:

a generally flat rectangular member;

a plurality of spaced-apart generally triangular projections integral with said rectangular member; and a plurality of projections integral with tops of said triangular projections, each of said projections having a notch therein the width of which is approximately equal to a width of said central portion between said generally oval-shaped aperture and one of said generally rectangular apertures in one of said slotted beam contacts, said triangular projections limiting the extent of engagement of said slotted beam contacts with said rectangular member.

11. The apparatus in accordance with claim 10 wherein:

said anchoring means includes a projecting lip along an edge of greater extent of said rectangular member; and said outer sidewall of said second connector body member includes a groove therein for engaging said projecting lip to provide polarized mating of said anchoring means with said second connector body member.

12. The apparatus in accordance with claim 1 wherein:

said first connector includes a longitudinally extending body member, a plurality of spaced-apart teeth integral with said body member and extending generally perpendicular to an axis of said body member, and means, integral with each of said teeth, for securely coupling said second connector to said first connector, and said second connector includes first and second spaced-apart sidewalls; and means, integral with said first and second sidewalls, for engaging said first connector coupling means.

13. The apparatus in accordance with claim 12 wherein:

said first connector coupling means comprises a plurality of truncated cylindrical projections, each projection having a greater thickness near its edge opposite a tip of said spaced-apart teeth; and said second connector engaging means comprises a plurality of generally circular apertures, said apertures aligned in correspondence with said truncated cylindrical projections, said apertures surrounding said projections and said greater thickness inhibiting separation of said first and second connectors after said connectors are mated.

14. The apparatus in accordance with claim 1 wherein said second connector includes:

a longitudinally extending body member;

a plurality of spaced-apart, alternating height teeth integral with said body member; and means, integral with each of said teeth and extending outwardly therefrom on opposite sides, for increasing electrical isolation among exposed ends of said second conductors.

15. The apparatus in accordance with claim 14 further including:

a plurality of projecting lips on outer side edges of alternate ones of said electrical isolation increasing means, said projecting lips facilitating engagement of a test cord with said second connector.

16. The apparatus in accordance with claim 14 further including:

pairs of opposed interference projections on adjacent sidewalls of said spaced-apart teeth, each of said projections having a thickness of greater extent at a central point which is removed from a tip of said spaced-apart teeth, said projections facilitating capture of said second conductors in said second connector.

17. Apparatus for electrically interconnecting first conductors with associated second conductors comprising:

first and second mating connectors made of an electrically insulative material, said first connector having provision therein for individually receiving and indexing said first conductors, ends of which are exposed along one side of said first connector;

a plurality of slotted beam contacts, each of said contacts including a central portion having a generally oval-shaped aperture therein, first and second pairs of oppositely directed cantilever beams, each of said beams in said pairs of beams spaced apart from one another by an elongated generally rectangular aperture extending from said central portion a predetermined distance along said beams, said first pair of beams being shorter in length than said second pair of beams, and first and second oppositely directed insulation-penetrating edges at ends of each of said beams in said pairs of beams, means, integral with said second connector, for holding said slotted beam contacts in a predetermined spatial relationship wherein said slotted beam contacts are engageable with said first and second conductors, respectively; and means, integral with said second connector, for encasing said exposed ends of said first conductors to electrically isolate them from one another.

18. The apparatus in accordance with claim 17 wherein said slotted beam contact holding means comprises:

a body member having a plurality of elongated generally rectangular cavities therein for slidably engaging said plurality of slotted beam contacts;

channel cavity means extending partially along planar inner sidewalls of said cavities;

an outer sidewall extending along a length of said body member, said outer sidewall having a plurality of spaced-apart apertures therein aligned in one-to-one correspondence with said plurality of rectangular cavities and said channel cavity means; and means, engageable with said aligned plurality of apertures in said outer sidewall, one of said elongated generally rectangular apertures in said plurality of slotted beam contacts and said generally oval-shaped aperture in said contacts, and said channel cavity means, for anchoring said slotted beam contacts in said second connector.

19. The apparatus in accordance with claim 18 wherein said anchoring means comprises;

a generally flat rectangular member;

a plurality of spaced-apart generally triangular projections integral with said rectangular member; and a plurality of projections integral with tops of said triangular projections, each of each projections having a notch therein the width of which is approximately equal to a width of said central portion between said generally oval-shaped aperture and one of said generally rectangular apertures in one of said slotted beam contacts, said triangular projections limiting the extent of engagement of said slotted beam contacts with said rectangular member.

20. The apparatus in accordance with claim 19 wherein:

said anchoring means includes a projecting lip along an edge of greater extent of said rectangular member; and said outer sidewall of said second connector body member includes a groove therein for engaging said projecting lip to provide polarized mating of said anchoring means with said second connector body member.

* * * * *